United States Patent [19]

Konle

[11] Patent Number: 4,979,670

[45] Date of Patent: Dec. 25, 1990

[54] APPARATUS FOR SENSING OBJECTS ON A MOVING CONVEYOR

[75] Inventor: Dale Konle, Watertown, Wis.

[73] Assignee: Quad/Tech, Inc.

[21] Appl. No.: 329,770

[22] Filed: Mar. 28, 1989

[51] Int. Cl.[5] ..... G06M 7/06

[52] U.S. Cl. ..... 235/98 R; 235/98 B; 116/204; 116/303; 198/502.1; 200/61.42; 226/100; 377/8

[58] Field of Search ..... 235/98 R, 98 B, 98 C, 235/98 A, 99 R; 377/3, 6, 8, 9, 12, 17; 116/204, 303; 198/502.1; 200/61.42; 226/100

[56] References Cited

U.S. PATENT DOCUMENTS 3,577,955 5/1971 Palmer ..... 235/98 B X
3,702,925 11/1972 Anderson et al. ..... 235/98 R
4,148,393 4/1979 Wiseman ..... 235/98 B X
4,562,339 12/1985 Sjogren et al. ..... 235/98 R
4,713,831 12/1987 Morisod ..... 235/98 B X

*Primary Examiner*—Benjamin R. Fuller

[57] ABSTRACT

A sensor for sensing and counting objects on a moving conveyor. Objects are moved on the conveyor past a sensor having first and second legs pivotally mounted about a fixed axis above the conveyor. The second leg is offset from the first leg in the direction of conveyor movement. As an object encounters the first leg, it causes the first leg to rotate toward the second leg. A proximity detector includes a target mounted on the first leg and a sensing element mounted on the second leg. The proximity detector detects movement of the first leg relative to the second leg and generates a pulse, thereby counting the object, when the first leg assumes a predetermined position relative to the second leg.

19 Claims, 10 Drawing Sheets

APPARATUS FOR SENSING OBJECTS ON A MOVING CONVEYOR

BACKGROUND OF THE INVENTION

1. Field of the Invention

The present invention relates, generally, to methods and apparatus for sensing objects on a conveyor, and in particular, to methods and apparatus for sensing successive signatures of printed matter.

2. Description of the Prior Art

In various contexts it is necessary to sense, and maintain a count of, objects being conveyed past a given point. For example, in the printing industry, it is often necessary to sense and maintain a count of signatures passing various points in a printing or binding operation. Mechanisms for sensing signatures, often referred to as signature counters (which generate corresponding electrical pulses to a counter) are, in general, known. For example, prior art signature counters are described in U.S. Pat. No. 3,702,925 issued to Anderson et al. on Nov. 14, 1972 and, U.S. Pat. No. 4,562,339 issued to Sjogren et al. on Dec. 31, 1985.

Such prior art counters tend to be disadvantageous in that they do not readily accommodate objects of varying height or stacks of overlapping objects, such as, e.g., overlapping signatures. For example, certain prior art signature counters include a mechanical trip switch supported by respective rollers, with the arm of the trip switch extending radially beyond the perimeter of the rollers. Typically, the roller/switch assembly is mounted over the conveyor on a pivotal lever arm, or on guide posts, to permit the vertical disposition of the counter relative to the conveyor surface to vary, the rollers being offset from the conveyor surface and the trip arm extending downwardly and forwardly (opposite the direction of conveyance) to a predetermined level above the conveyor (proximate to the conveyor surface where relatively thin signatures are to be sensed). In operation, the leading edge of a signature trips the switch arm, and thereafter the rollers ride over the edge of the signature, lifting the unit to a higher vertical level. Such prior art counters tended to be relatively massive and the response time to variations in height (or numbers of overlapping objects) tended to be slow, placing limitations on the speed of the conveyor. In addition, where prior art signature counters were used with a high speed conveyor, contact between the counter and the signatures tended to cause bounce, often resulting in miscounts. Further, where the prior art counters were designed for high sensitivity, they tended to be particularly susceptible to spurious counts caused by in continuities in the surface of the object, such as bunching in the signature.

Accordingly, there is a need for a sensor, and particularly a signature counter, that can be mounted in a fixed position without necessitating adjustment for sensing objects such as signatures of various sizes or lapping of varying numbers of signatures, and which is of relatively high sensitivity yet tolerant of surface irregularities in the object, e.g., rippling (bunching) in a signature, and which reacts quickly to changes in the height of the objects being counted.

SUMMARY OF THE INVENTION

The present invention provides methods and apparatus for sensing and counting successive objects moving relative thereto on a conveyor. In accordance with one aspect of a preferred embodiment, first and second levers are pivotally mounted above the plane of conveyance, the first lever being disposed forwardly of and spaced apart from the second lever. An object to be counted passes underneath and engages the distal end of the first lever, transporting it along its arc until the object engages the second lever, at which time both levers are simultaneously transported along their respective arcs. When the two levers assume a predetermined relative position (hereinafter "proximity relation"), indicia, e.g., a pulse, is generated. Thereafter, in traversing the arc the distal end of the first lever reaches the height of and rides over the object, terminating the proximity relation between the levers. The second lever then rides over the object and the distal ends of both levers remain at approximately the same height (ride on the surface of the object) out of proximity relation until the first lever engages the next successive object, and the process is repeated. The indicia may be accumulated to provide a count of the objects.

The sensing apparatus in accordance with the present invention is advantageous in that it may be mounted in a fixed position above the conveying surface without the need for adjustment to accommodate bundles of signatures of varying heights.

A further advantage of the present invention involves the geometric flexibility of the sensor, permitting a high degree of sensitivity for very thin signatures, even when stacked relatively high and overlapped with, for example, relatively thick signatures. In addition, the lightweight nature of the components reduces inertial forces, facilitating high speed conveyance of the signatures with minimal counting errors.

BRIEF DESCRIPTION OF THE DRAWING

Preferred exemplary embodiments of the present invention will hereinafter one described in conjunction with the appended drawing, wherein like numerals denote like elements, and.

THE DETAILED DESCRIPTION OF PREFERRED EXEMPLARY EMBODIMENTS

Figure 1:
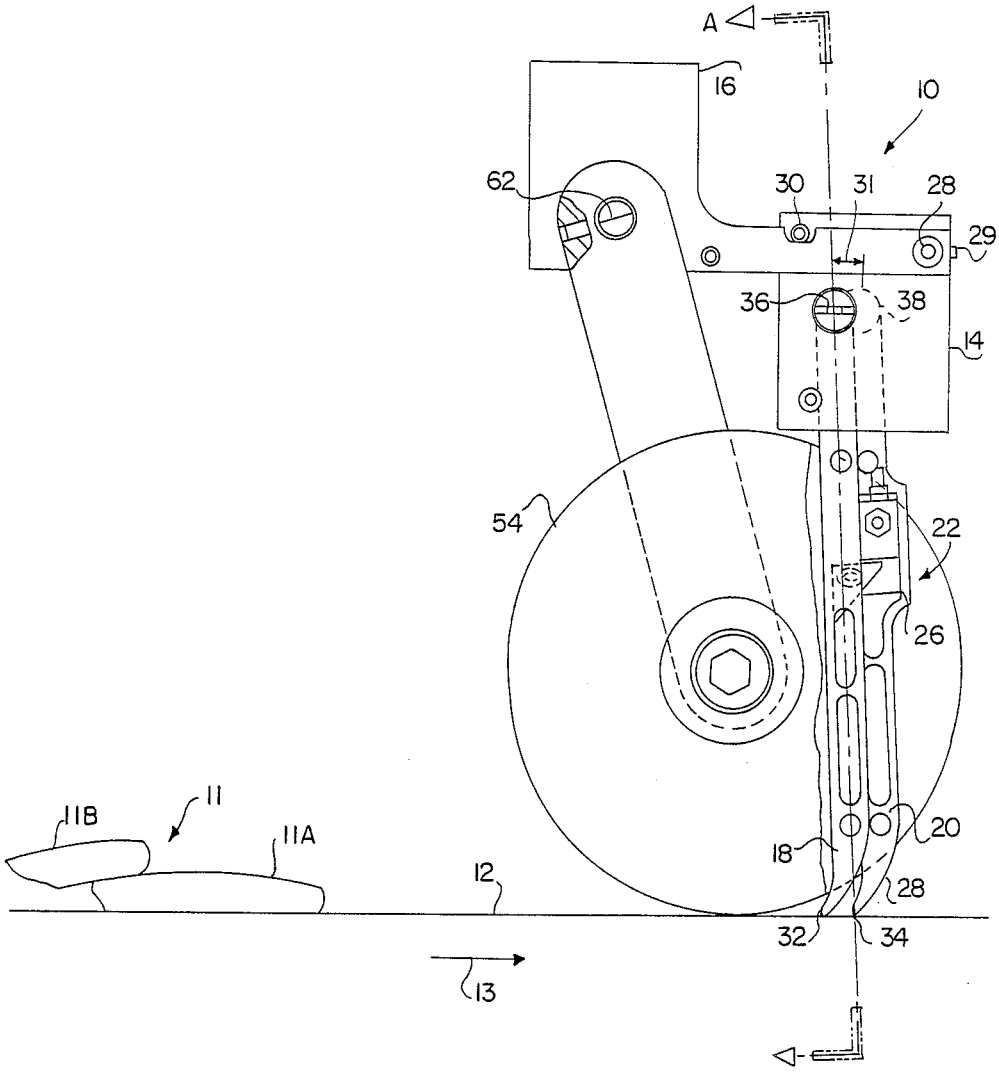
FIG. 1 is a partially cut away side elevation view of a preferred embodiment of an apparatus for sensing objects on a moving conveyor in accordance with the present invention.
Figure 2:
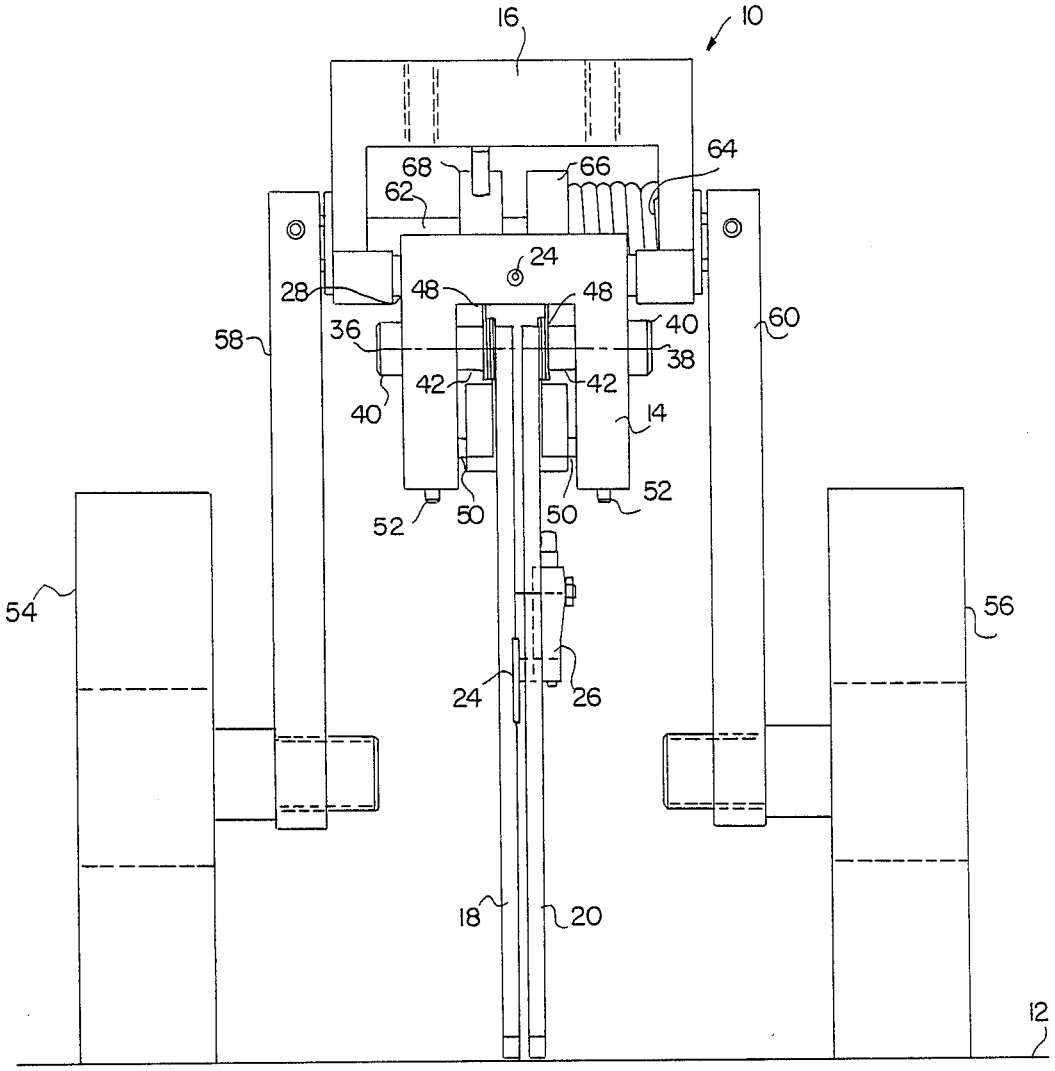
FIG. 2 is a front elevation view of the apparatus of FIG. 1.
Figure 3:
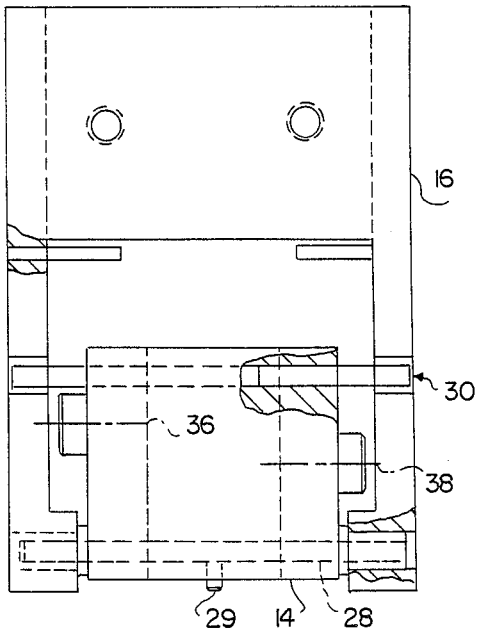
FIG. 3 is a partially cut away top view of the body block and frame of the apparatus of FIG. 1.

With reference now to FIGS. 1–3, a preferred embodiment of the present invention, a signature sensor 10, is mounted above a conveyance surface 12. Conveyor surface 12 may comprise, by way of non-limiting example, the surface of a conveyor belt, rollers, springs, a moving substrate, or a surface upon which objects are moved, as is well known in the art. A sequence of individual signatures 11 are suitably moved along surface 12 in a direction indicated by arrow 13 (sometimes referred to as the director of movement or direction of conveyance). Signatures 11 may overlap, as illustrated in FIG. 1 (signatures 11A and 11B).

Signature sensor 10 suitably comprises a mounting block (also sometimes referred to as pivot body) 14, a mounting frame 16, a first leg (member) 18 having a rear edge 23, a second leg (member) 20, and a suitable proximity detector 22, comprising a target element 24 and sensing element 26.

Apparatus 10 is secured to a suitable stable structure (not shown) above conveyance surface 12 by mounting frame 16. To accommodate momentary reversals in the direction of movement of signatures 11, mounting block 14 is pivotally mounted, suitably using a pin 28 journaled through block 14 and respective opposing arms of frame 16, and secured in block 14 by a set screw 29. A second pin 30, suitably a spring steel roll pin extending outwardly from mounting block 14, is received in depressions in the arms of frame 16 and is employed to limit the extent of counterclockwise rotation of the block. This defines a normal operating position.

Legs 18 and 20 are suitably lengths of lightweight, rigid material such as, for example, aluminum or fiberglass. If desired, legs 18 and 20 may be generally planar with one end (32, 34) hooked forwardly (opposing the direction of conveyance 13) to provide respective contact surfaces forward of the main length of the leg. Portions of legs 18 and 20 may also be cut away to reduce weight. Alternatively, legs 18 and 20 can be formed of, for example, rigid lengths of wire or other material. Legs 18, 20 are suitably approximately the same length, for example, five inches.

Legs 18 and 20 are pivotally mounted to block 14 for rotation about respective axes 36 and 38. Axis 36 is disposed perpendicular to, and in a plane parallel to, direction of movement 13. Axis 38 is parallel to axis 36, and also in the plane parallel to the direction of movement 13, but rearwardly offset by a predetermined distance El, suitably 0.25". Distance El is preferably less than the lowest offset between lapping signatures contemplated in the environment in which the counter 10 is to be used.

Figure 1A:
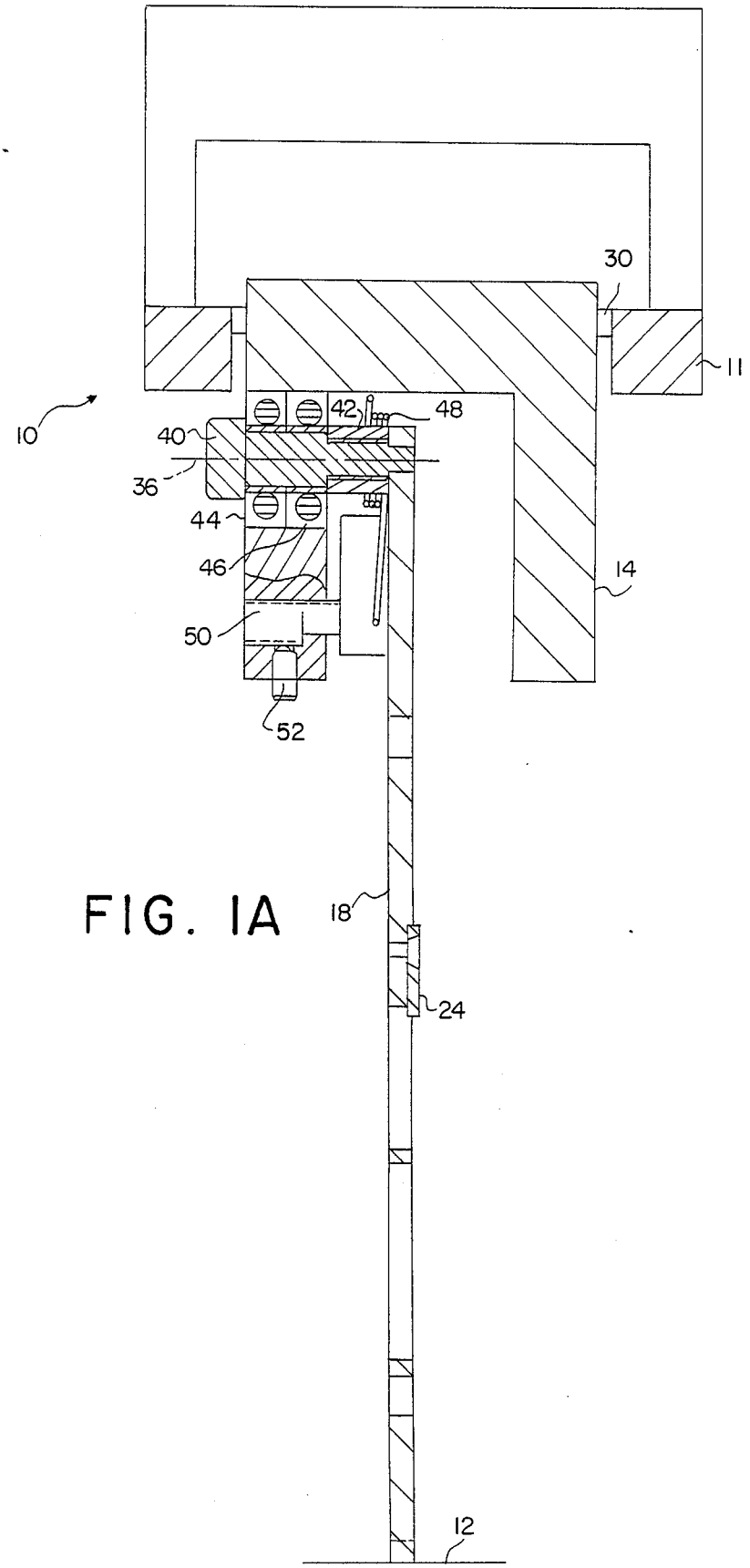
FIG. 1A is a sectional view of the apparatus of FIG. 1 taken along Section A.

More specifically, as best seen in FIGS. 1A and 2, leg 18 is threadedly connected to a suitable shoulder bolt 40 cooperating with a suitable spacer 42. Shoulder bolt 40 is maintained within the inner races of respective antifriction bearings (e.g. ball bearings) 44 and 46, suitably press fit into bores in the side of mounting block 14. Two sets of ball bearings are suitably used to provide additional stability for mounting of leg 18. The center of shoulder bolt 40 is disposed along axis 36. Leg 18 is suitably biased in a clockwise direction (against movement in the direction of conveyance 13) by a conventional torsion spring 48, which cooperates with a limiting stop 50 to define a normal resting position with contact surface (tip) 32 of the leg disposed in line with axis 36 along a perpendicular to direction of motion 13.

Limit stop 50 suitably comprises an eccentric cam rotatably mounted in the sidewall of mounting block 14, and extending into the interior of mounting block 14 to interact with leg 18. If desired, leg 18 may include a projecting portion to facilitate cooperation with stop 50. A set screw 52 is suitably provided through block 14 to fix the position of eccentric 50. Use of an eccentric limit stop permits adjustment of the resting position of leg 18. As indicated in FIG. 1, an essentially identical assembly is provided on the opposite side of body block 14 to pivotally mount leg 20.

Referring again to FIG. 1, respective signature stabilizer wheels 54 and 56 suitably formed of a relatively soft, shock absorbing material, may be provided on either side of legs 18 and 20. (Wheel 54 is shown partly cut away in FIG. 1, for clarity.) Wheels 54 and 56 are secured to a common shaft 62 which is journaled through mounting frame 16. If desired, suitable bearings can be employed to rotatably mount shaft 62 to frame 16.

An adjustable rotary bias is provided on common shaft 62, and thus wheels 54 and 56. More specifically, a conventional torsion spring 64 is disposed about shaft 62, with one end secured to frame 16, and the other end secured to a split collar 66. By rotating collar 66, and thus the end of torsion spring 64 about shaft 62, the amount and direction of bias can be varied. A suitable stop collar 68 is also provided on shaft 62, which cooperates with frame 16 to limit the travel of shaft 62, and thus wheels 54 and 56, to a predetermined range.

The respective elements of proximity detector 22 are mounted on legs 18 and 20. More specifically, proximity detector 22 is suitably an inductive proximity detector, such as a SUNX GXL-8f inductive proximity dectector, comprising a target 24 and sensing element 26. Sensing element 26 generates a pulse when target 24 and sensing element 26 come into predetermined relative positions (proximity relation). As will hereinafter be explained, target 24 is suitably configured with a rearward facing edge 25 (the edge initially interacting with sensing element 26) of a predetermined contour. Target element 24 is suitably mounted on forward leg 18; sensing element 26 is suitably mounted on rear leg 20 with the certer of sensor 26 disposed a constant distance Sl, for example approximately 2.2 inches, from axis 38. It should be appreciated that other forms of proximity detection can be employed, such as, for example, optical proximity detectors, magnetic proximity detectors, or absolute position comparison mechanisms.

With reference now to FIGS. 4–7, the operation of apparatus 10 will be described. For clarity and ease of illustration, wheels 54 and 56 are not shown in FIGS. 4–7, and mounting frame 16 is omitted from FIGS. 5–7.

Apparatus 10 is mounted above conveyance surface 12 with the contact surfaces 32, 34 of legs 18 and 20 closely proximate to surface 12. When not interacting with signatures 11, legs 18 and 20 are biased against eccentric stop 50 and assume a position with contact surfaces 32 and 34 in line with axes 36 and 38, respectively, along perpendiculars to direction of motion 13. In the resting position, target 24 is not proximate to sensor 22 (i.e., is outside of proximity relation).

Figure 4:
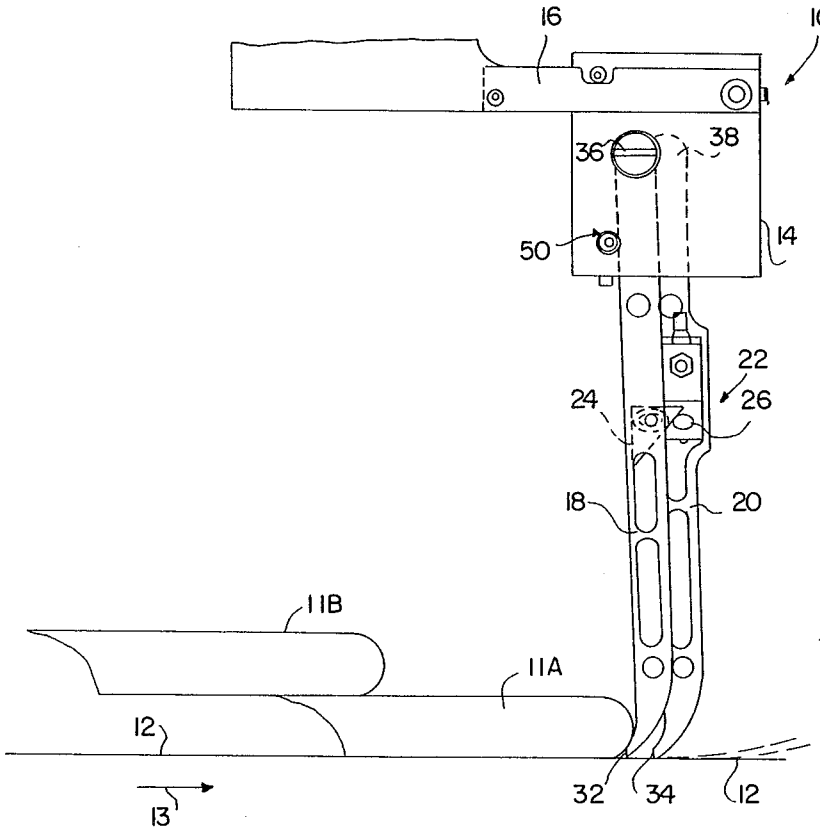

Signature 11 initially engages forward leg 18, as illustrated in FIG. 4. Leg 18 is forced rearwardly (counterclockwise) along an arc 78 centered at axis 36. Target 24 is disposed on leg 18 relative to the disposition of sensing element 26 such that target 24 comes into proximity relation with sensing element 26 prior to or coincident with the engagement of rear leg 20 by signature 11A, causing sensing element 26 to generate an output pulse. The output pulses from sensing element 22 are suitably accumulated by a conventional counter (not shown).

Figure 5:
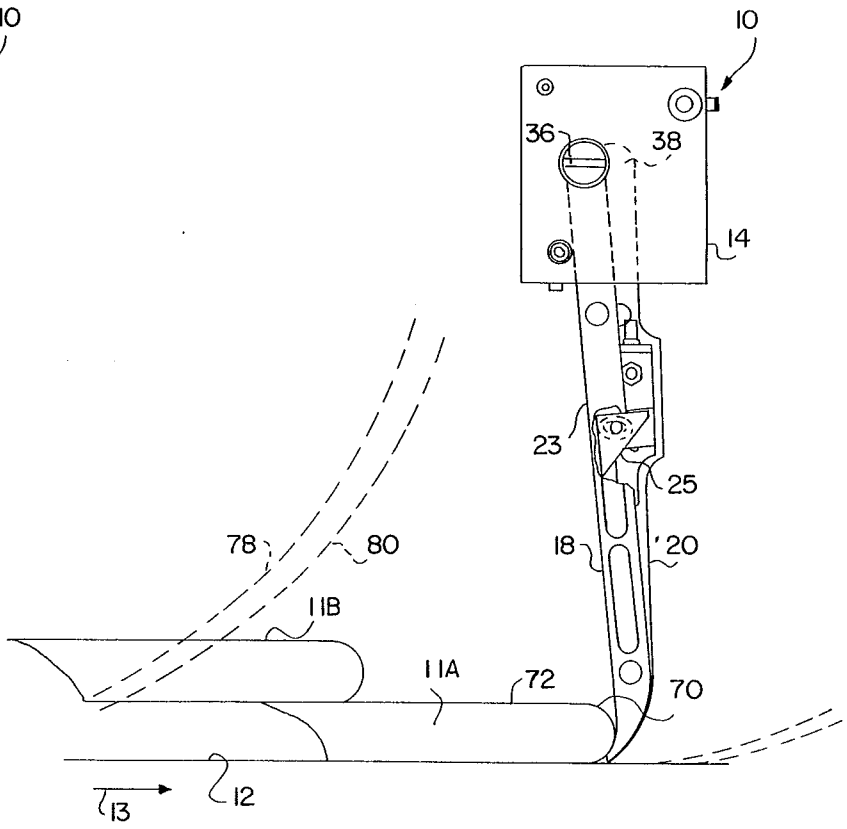
FIGS. 4–7 are side elevational views illustrating the operation of the apparatus of FIG. 1.
Figure 6:
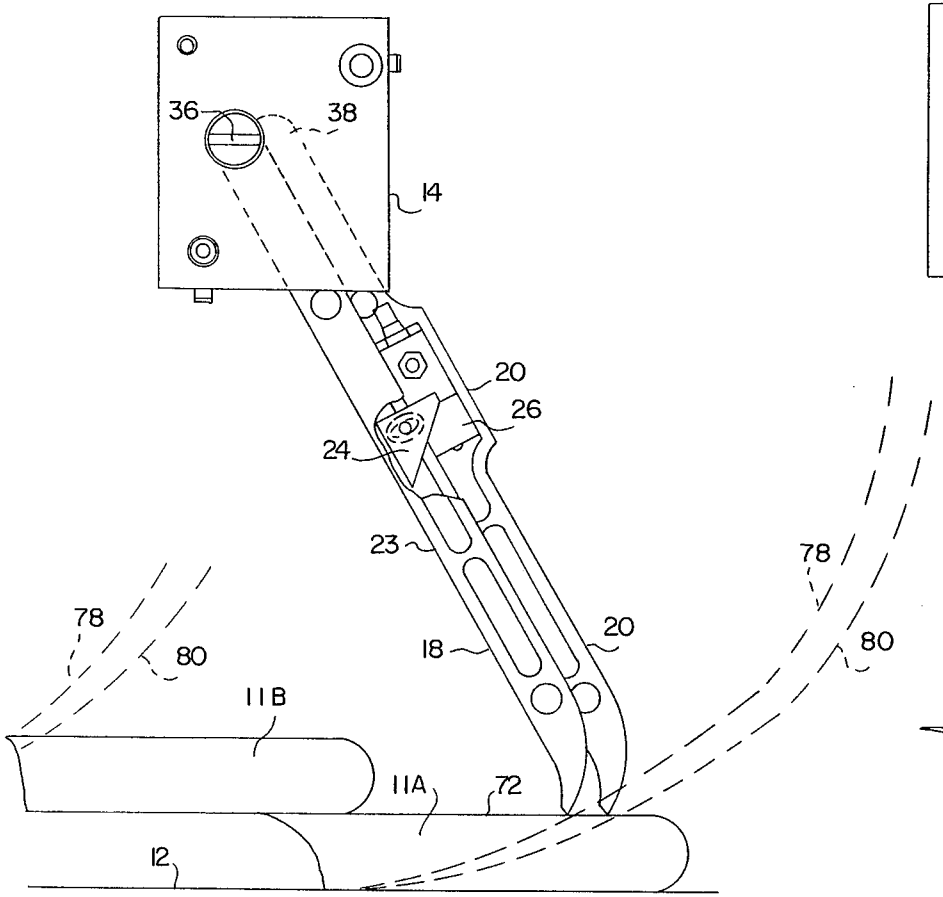

At some point after the pulse has been generated by sensing element 26, signature 11A engages rear leg 20, as illustrated in FIG. 5. Further travel of signature 11A in the direction of motion 13 forces leg 18 rearwardly further along arc 78, and leg 20 rearwardly (counterclockwise) along arc 80 centered at axis 38. Such rearward motion cf legs 18 and 20 continues until such time as legs 18 and 20, respectively, reach points in arcs 78 and 80 corresponding to the level of the upper surface 72. Legs 18 and 20, in turn, then ride over the edge 70 of signature 11A, and onto upper surface 72, as illustrated in FIG. 6. Inasmuch as leg 18 is disposed forwardly of leg 20 (and arc 78 is forward of arc 80) leg 18 will normally ride over edge 70 before leg 20. Signature surface 72 is generally parallel to the direction of motion 13 (and conveyor 12), and legs 18 and 20 assume generally parallel offset relative positions (analogous to their relative positions at rest) with target 24 displaced from proximity relation with sensing element 26. The spring bias of legs 18 and 20 ensures that an out-of-proximity relation is assumed quickly upon leg 18 (and then leg 20) overriding edge 70, thus facilitating high speed conveyance and the use of relatively small offsets between overlapping signatures.

Figure 7:
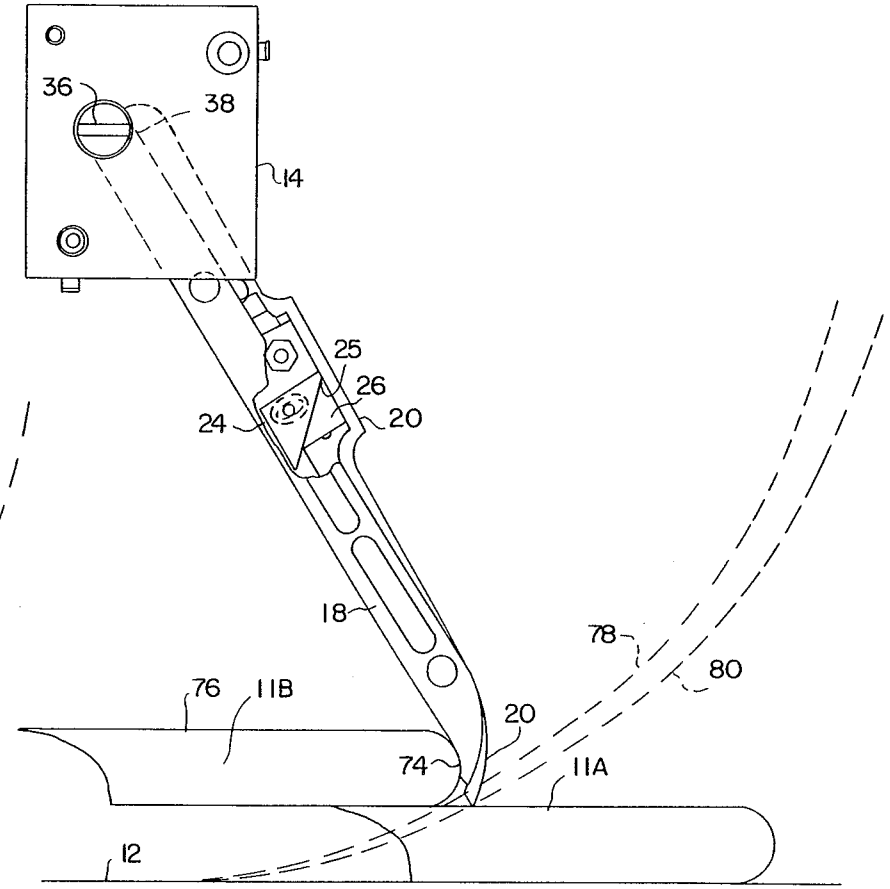

The out-of-proximity relative position is maintained as legs 18 and 20 ride along upper surface 72 of signature 11A, and until forward leg 18 is engaged by the leading edge 74 of a lapping (partially overlying) signature 11B (FIG. 7). Continued motion of signature 11B along direction 13 forces forward leg 18 in a counterclockwise direction further along arc 78, ultimately bringing target 24 into proximity relation with sensing element 26. Sensing element 26 accordingly generates a further pulse.

At some point thereafter, edge 74 of signature 11B engages rear leg 20, forcing rear leg 20 in a counterclockwise direction along arc 80, as well as forcing leg 18 along arc 78, until legs 18 and 20 ride over edge 74 onto the upper surface 76 of signature 11B. Legs 18 and 20 at that point reassume their out-of-proximity relative disposition in preparation for generation of the next pulse. The out-of-proximity relative disposition will be maintained until the interaction of leg 18 with the leading edge of a successive overlapping signature. As legs 18 and 19 ride over the last overlapping signature in a particular sequence (or bundle) of signatures, they are spring biased into the resting position against stops 50 for interaction with the next signature disposed on conveyance surface 12.

The foregoing embodiment of signature counter 10 is capable of detecting extremely thin signatures (e.g., thickness 0.006 inch or less). As previously noted, legs 18 and 20 are biased into a resting position with contact surfaces 32 and 34 on the perpendiculars in line with axes 36 and 38, and preferably proximate to, e.g., as close as feasibly possible to, surface 12. The perpendiculars to axes 36 and 38 define points along arcs 78 and 80 tangential to surface 12. In these portions of arcs 78 and 80, the thickness of signature 11 tends not to be a significant limiting factor with respect to travel of legs 18 and 20.

Leg 18 is moved rearwardly along arc 78 until the upper surface of signature 11A crosses arc 78, at which points leg 18 rides over edge 70. Since the initial interaction between the first signature and each leg is at the tangent (8=0), the arcs diverge from the signature path only gradually in the vicinity of $\theta$. A substantial length of the signature path (depending upon the radius of the arc but greater than the thickness of the signature) is traversed by signature 11 (and leg 18 concomitantly displaced) before upper surface 70 intersects arc 73 and leg 18 rides over edge 70. The same relationship folds with respect to the interaction of signature 11, leg 20 and arc 80.

Specifically, the distance d along direction 13 traversed by a signature before a leg 18 of length r rides over the edge of a signature of thickness t (initial interaction at resting position proximate surface 12) is in accordance with the following formula:

$$d=(r)\sin[\cos^{-1}(1-t/r)]$$

The same relationship is tree relative to leg 20 and arc 80. Thinness of signature 11 is generally not a limiting factor with respect to travel of legs 18 and 20, and hence target 24 with respect to sensor 26.

As signatures are lapped, and the initial point of interaction is thereby offset along arc 78 from the tangent, the foregoing formula no longer applies. Rather, as the offset angle $\theta$ along arc 78 exceeds 0°, the distance $d_n$ traveled by the nth lapped signature, from the point at which the edge of the signature engages leg 18 to the point at which leg 18 rides over the edge of the signature (assuming that the distal end of leg 18 (or leg 20) is at an initial height h above surface 12 when the nth signature of thickness t engages the leg) is in accordance with the more general formula:

$$dn=r\sin[\cos^{-1}(1-[h+t/r)]-r\sin[\cos^{-1}(1-h/r)]$$

Thus, until the cumulative height of the signatures reaches a level corresponding to $\theta=45°$, the travel distance $d_n$ of legs 18 (and ultimately leg 20) caused by engagement with the next overlapping signature will exceed the thickness of the signature.

The relative disposition of legs 18 and 20, and the elements of proximity detector 22 is such that, irrespective of the angle $\theta$ at the point that a signature 11 first engages leg 18: (a) the sensor elements are in an out-of-proximity relation just prior to such engagement (i.e., with the distal ends of legs 18 and 20 riding on the upper surface of the preceding signature or in the resting position); and (b) the sensor elements are brought into proximity relation (i) before or coincident with the signature engaging rear leg 20 and (ii) before leg 18 rides over the edge of the signature.

As the level of the surface on which legs 18 and 20 ride relative to surface 12 increases, $\theta$ at the point the signature 11 at issue first engages forward legs 18 (the initial $\theta$) increases; consequently, the offset between legs 18 and 20 when the signature engages leg 18 (i.e., the horizontal component of travel of leg 18 before signature 11 engages leg 20) decreases from El, e.g. 0.25 inch at $\theta=0°$, to approximately zero at $\theta=90°$. However, the radial disposition (toward the distal end of leg 18) of the target relative to sensor 26 also moves with $\theta$ as a result of the offset of axes 6 and 38. Particularly, the radial position of the point ("trigger point") on target 24 that interacts with the center of sensor 26 is displaced from an initial position at $\theta=0$. The radial displacement of the target point increases with $\theta$, ultimately equaling El, the offset between axes 36 and 38, at $\theta=90°$.

To ensure that signature sensor 10 manifests an approximately linear sensitivity (i.e., that the minimum detectable signature thickness remains substantially constant) over the range of $\theta$ from 0° to approximately 90°, target 24 preferably has a leading edge 25 contoured in accordance with the difference in the relative positions of target 24 and sensor 26 for the various angles of inclination of leg 20. In particular, the position of each point comprising contour 25 relative to rear edge 23 of leg 18 varies as a function of the radial position of sensor 26 to compensate for the varying offset between legs 18 and 20 as $\theta$ increases. Hence, to the extent that target 24 must travel a varying distance (between El and zero, depending on $\theta$) to come into proximity relation with sensor 26 as the signature to be sensed engages leg 18, target edge 25 is contoured to displace the appropriate target point from sensor 26 by a corresponding amount.

As a general proposition, target 24 may be designed such that for each radial position of leg 20, the corresponding trigger point on contour 25 is approximately "line-to-line" with the center of sensor 26, i.e., edge 25 is contoured such that a point on the edge overlies the center of sensor 26 with legs 18 and 20 in parallel disposition for each $\theta$. Contour 25 may then be angularly displaced (by an approximately constant amount for each $\theta$) by an amount sufficient to take the edge into an out-of-proximity position when the legs are in parallel disposition.

Figure 8:
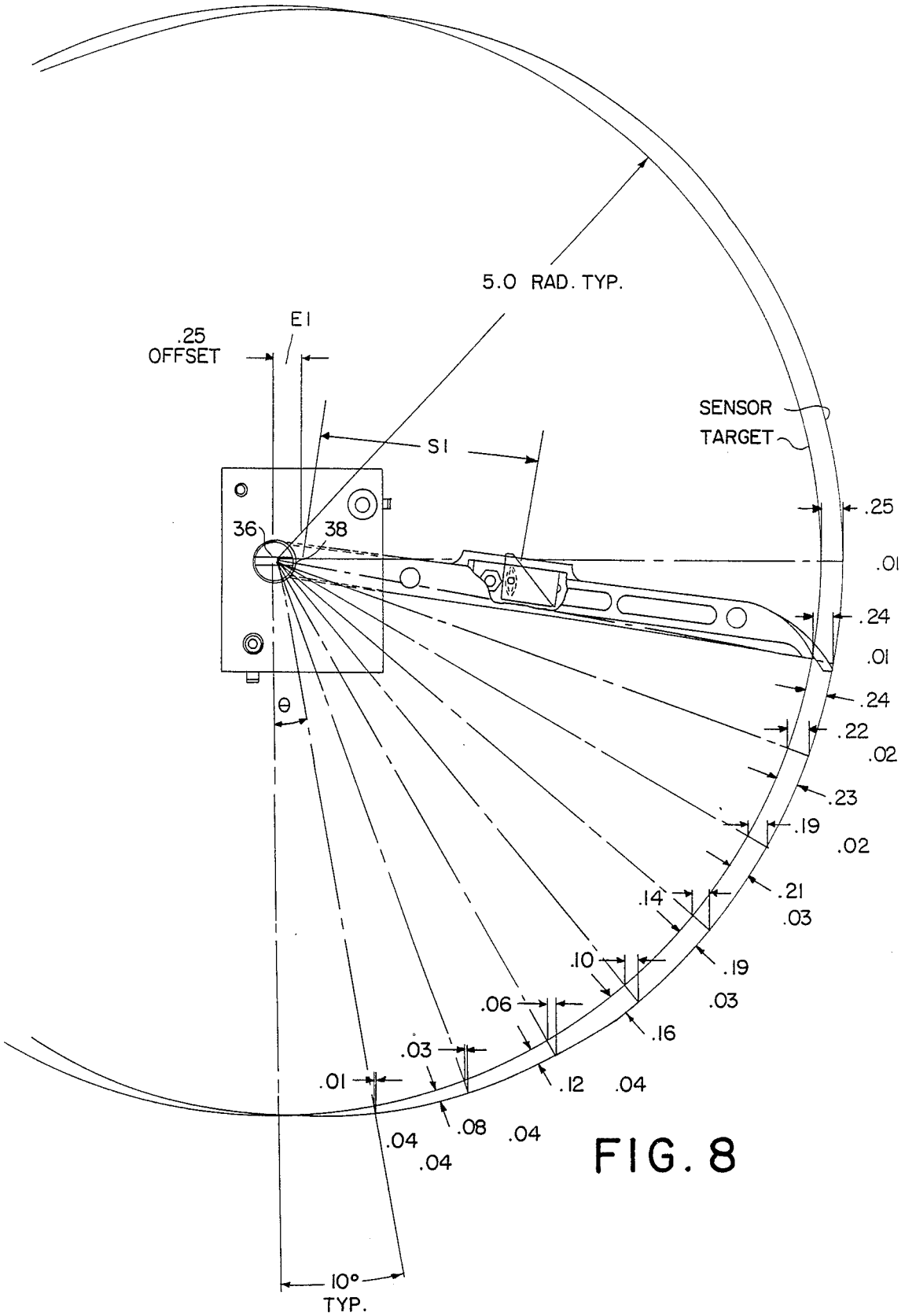
FIG. 8 is a schematic illustration of the variation in the relative radial positions of the sensor elements as angle $\theta$ increases.

More specifically, the locus of points comprising leading edge 25 of target 24 are disposed such that the trigger point on the edge corresponding to the center of sensor 26 at $\theta=0$ (tangent to signature path) is disposed at a distance from the sensor center equal to the minimum actuate travel by leg 18 in response to a typical signature having a minimum desired thickness. As noted, the trigger point corresponding to the center of sensor 26 at $\theta=90°$ is displaced from the trigger point at $\theta=0°$ (toward the distal end of leg 18) by an amount approximately equal to the distance between respective axes 36 and 38 (El). Target 24 is contoured such that edge 25, on the arc corresponding to the radial position of the center of sensor 26 at $\theta=90°$, is displaced from the center of sensor 26 by approximately the same minimum travel when legs 18 and 20 are in parallel disposition at $\theta=0°$; the trigger point along the arc corresponding to the position of the sensor is, in effect, angularly displaced from the trigger point at $\theta=0°$ by an amount corresponding to the difference in travel at $\theta=90°$ as compared to $\theta=0°$, namely El. Between $\theta=0°$ and $\theta=90$, contour 25 varies in accordance with the distance between the center of sensor 26 and axis 36. As best viewed in FIG. 8, the center of sensor 26 remains a constant distance Sl from axis 38. However, the distance between the center of sensor 26 and axis 36, about which target 24 pivots, increase as a function of $\theta$. Accordingly, the distance R of "cam" contour 25 from axis 36 may be expressed as a function of $\theta$, the angle of inclination of leg 20:

$$R=[(El)^2+(Sl)^2+2(El)(Sl)\sin\theta]^{\frac{1}{2}}$$

where El is the distance between respective axes 36 and 38 and Sl is the distance from axis 38 to the center of sensor 26. The angle of inclination, $\alpha$, of R with respect to a vertical line extending downwardly from axis 36 may be expressed as:

$$\alpha=\tan^{-1}[(El+(Sl)\sin\theta)/(Sl)\cos\theta)]$$

Alternatively, respective legs 18 and 20 may be of different lengths and mounted to block 14 at different points above surface 12 such that in the $\theta=0$ position the distal ends of both legs are proximate surface 12. Although respective axes 36, 38 would still be offset by a desired amount El, a different contour 25 would result. Regardless of the precise geometrical configuration of the respective legs, however, contour 25 will be configured such that a particular point thereon may, upon slight deflection of leg 18 in response to engagement by a signature, come into proximity with sensor 26.

Figure 9:
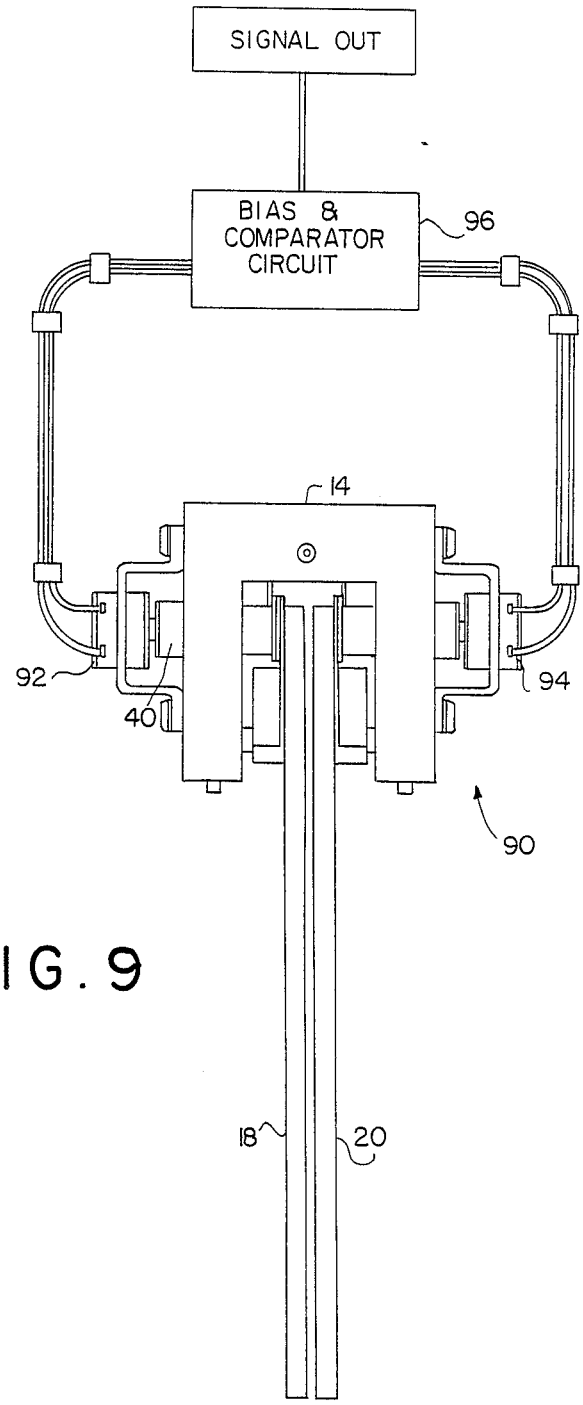
FIG. 9 is a schematic block illustration of a second exemplary embodiment of the present invention.

Referring now to FIG. 9, a second exemplary embodiment of the present invention, a signature sensor 90, will be described. Signature sensor 90 is substantially similar to signature sensor 10 except that, the respective elements of proximity detector 22 are omitted from legs 18 and 20, and respective encoders 92 and 94 are provided in cooperative relation with shoulder bolts 40, to generate analog signals indicative of the angular disposition ($\theta$) of legs 18 and 20, respectively. Encoders 92 and 94 are suitably relatively precise potentiameters which vary in resistance in accordance with the deviation of the associated leg from the tangential rest position, against stop 50 ($\theta=0$).

Figure 10:
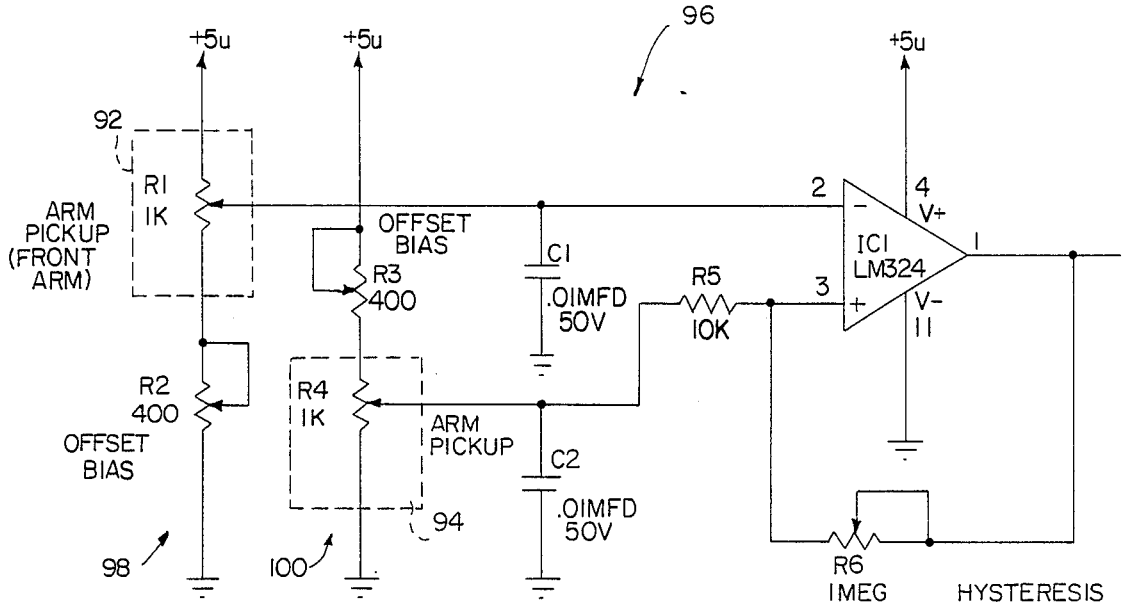
FIG. 10 is a schematic diagram of a bias and comparator circuit suitable for use with the embodiment of FIG. 10.
Figure 11:
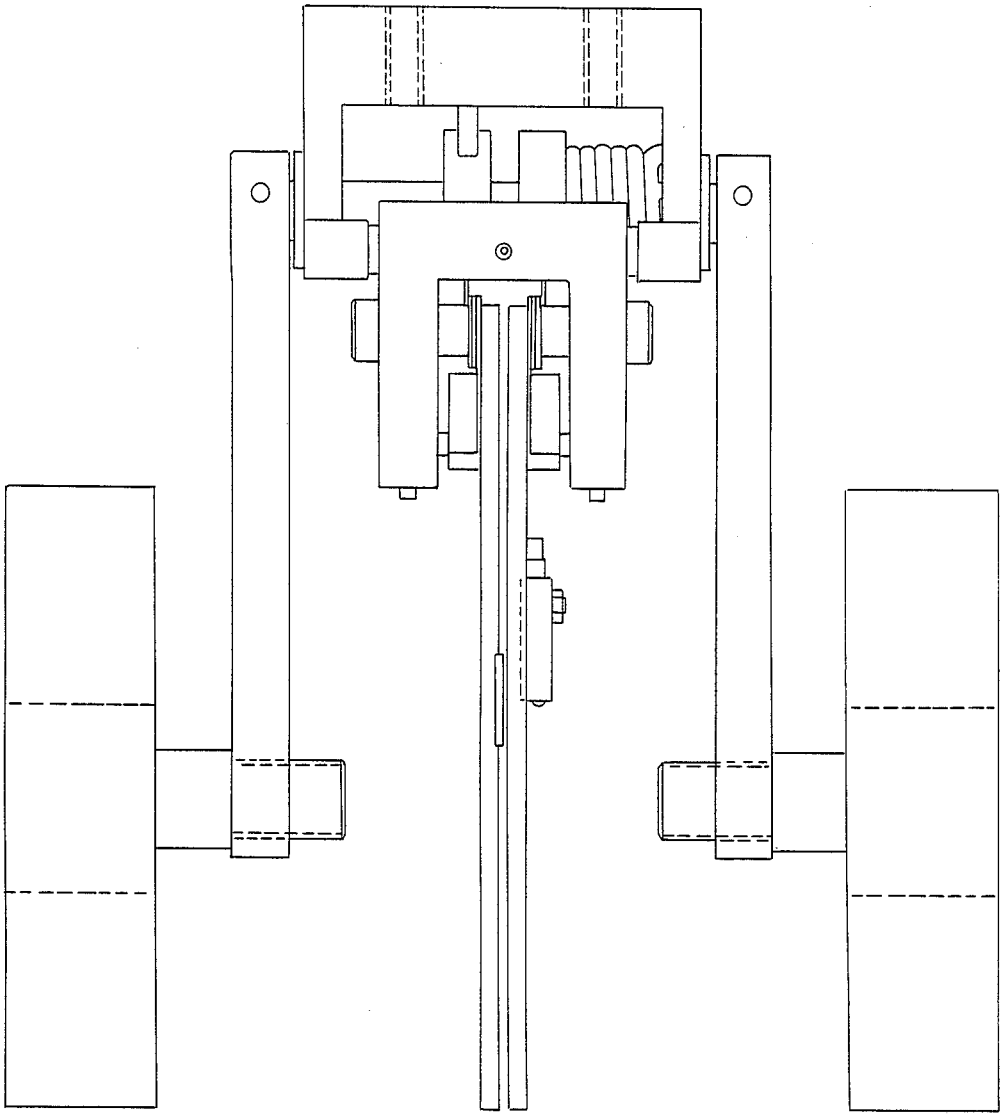
FIG. 11 is a front elevational view of the embodiment of FIG. 9, shown mounted on wheels.

Encoders 90 and 94 are electrically connected to a bias and comparator circuit 96. A suitable bias and comparator circuit 96 as shown in FIG. 10. Briefly, when the difference between the angles sensed for legs 18 and 20 exceeds a predetermined value, circuit 96 generates a pulse indicative of the passage of a signature. A hysteresis loop is preferably provided to, in effect, filter out small, spurious angular deviations.

It will be understood that the above description is of preferred exemplary embodiments of the present invention, and that the invention is not limited to the specific forms shown. These and other modifications may be made in the design and arrangement of the elements within the scope of the invention as expressed in the appended claims.

I claim:

1. Apparatus for sensing objects moving relative thereto in a predetermined direction in a plane of conveyance, said apparatus comprising:

a proximity detector having first and second elements for generating a signal each time said first and second elements assume a predetermined proximity relation;

a first leg, pivotally mounted about a first axis, said first axis being disposed substantially perpendicular to said predetermined direction in a plane substantially parallel to said plane of conveyance, said first leg being disposed with a free end thereof proximate to said plane of conveyance; said first detector element being mounted on said first leg;

a second leg, pivotally mounted about a second axis parallel to said first axis in a plane parallel to said plane of conveyance, offset by a predetermined distance in said predetermined direction, said second leg being disposed with a free end thereof proximate to said plane of conveyance; said second detector element being mounted on said second leg, in a position corresponding to the position of said first detector element on said first leg.

2. The apparatus of claim 1 wherein said first element is rigidly mounted to said first leg.

3. The apparatus of claim 2 wherein said second element is rigidly mounted to said second leg.

4. The apparatus of claim 1 wherein a distance between said free end of said firs leg and said first axis is approximately equal to a length of said first leg.

5. The apparatus of claim 4 wherein a distance between said plane of conveyance and said first axis is substantially constant.

6. Apparatus for sensing objects moving along a path in a predetermined direction, comprising:

a first follower having a first detector element rigidly mounted thereto;

a second follower having a second detector element associated therewith;

means for disposing said first follower for pivotal movement about a first axis in response to passage of said object;

means for disposing said second follower for pivotal movement abut a second axis in response to passage of said object, said second axis being offset from said first axis in said predetermined direction; and means for generating indicia of passage of said object in response to said followers assuming a predetermined relative angular disposition.

7. The apparatus of claim 6 wherein said first and second axes are disposed in a common plane parallel to said path.

8. The apparatus of claim 6 wherein:

said first follower comprises a firs free end thereof remote from said first axis; and said first detector element is disposed intermediate said first axis and said first free end of said first follower.

9. The apparatus of claim 8 wherein:

said second follower comprises a second free end remote from said second axis;

said second detector element is rigidly mounted to said second follower intermediate said second free end and said second axis; and said first and second detector elements are configured to assure a predetermined relative disposition when said first and second followers assume said predetermined relative angular disposition.

10. The apparatus of claim 9, wherein:

said first detector element comprises an inductive proximity detector;

said second detector element comprises a target having a predetermined cam profile configured for selective interaction with said inductive proximity detector in accordance with the relative disposition of said first and second followers.

11. A method for sensing objects moving along a predetermined path:

disposing a first leg for pivotal motion about a first axis such that passage of an object causes angular movement of said first leg about said first axis;

disposing a second leg for pivotal motion about a second axis such that passage of an object causes angular movement of said second leg about said second axis and said second axis being offset from said first axis by a predetermined amount in a direction of movement of said object along said path;

positioning a first element of a proximity detector in accordance with an angular position of said first leg;

positioning a second element of said proximity detector in accordance with an angular position of said second leg;

maintaining a fixed relative disposition between said first element and said first leg; and generating indicia of passage of said object in response to said legs assuming a predetermined relative angular disposition.

12. The method of claim 11 wherein said generating indicia step comprises:

sensing the respective angular dispositions of said first leg and said second leg and generating indicia of passage of said object when said relative angular disposition first exceeds a predetermined value.

13. The method of claim 11 wherein said generating indicia step comprises:

sensing when said first leg comes into a predetermined proximity relative with said second leg and responsively generating said indicia.

14. The method of claim 11 further comprising the step of:

maintaining a fixed relative disposition between said second element and said second leg.

15. The method of claim 11 wherein the step of maintaining comprises rigidly mounting said first element to said first leg.

16. The method of claim 15 further comprising the step of maintaining a fixed relative disposition between said second element and said second leg, wherein said step of maintaining a fixed relative disposition between said second element and said second leg comprises rigidly mounting said second element to said second leg.

17. The method of claim 11 wherein said generating step comprises bringing said first element into predetermined engagement with said second element.

18. The method of claim 11 wherein said generating step comprises establishing photo-optical engagement between said first and second elements.

19. The method of claim 11 wherein said generating step comprises establishing magnetically inductive engagement between said first and second elements.

* * * * *